US011773472B2

(12) United States Patent
Park et al.

(10) Patent No.: US 11,773,472 B2
(45) **Date of Patent: *Oct. 3, 2023**

(54) MAGNESIUM ALLOY SHEET AND METHOD FOR PRODUCING SAME

(71) Applicant: POSCO CO., LTD, Pohang-si (KR)

(72) Inventors: Jun Ho Park, Pohang-si (KR); Hyun Bom Lee, Pohang-si (KR); Jae Joong Kim, Pohang-si (KR); Oh-Duck Kwon, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 144 days.

This patent is subject to a terminal disclaimer.

(21) Appl. No.: 16/954,377

(22) PCT Filed: Dec. 21, 2018

(86) PCT No.: PCT/KR2018/016511

§ 371 (c)(1),
(2) Date: Jun. 16, 2020

(87) PCT Pub. No.: WO2019/132453

PCT Pub. Date: Jul. 4, 2019

(65) Prior Publication Data

US 2021/0079503 A1 Mar. 18, 2021

(30) Foreign Application Priority Data

Dec. 26, 2017 (KR) ..... 10-2017-0180115

(51) Int. Cl.
*C22C 23/02* (2006.01)
*B21B 3/00* (2006.01)
(Continued)

(52) U.S. Cl.
CPC ..... *C22C 23/02* (2013.01); *B21B 3/003* (2013.01); *C21D 8/0273* (2013.01); *C22F 1/06* (2013.01)

(58) Field of Classification Search
CPC ..... B21B 3/003; C21D 8/0273; C22C 23/02; C22C 23/04; C22F 1/06
(Continued)

(56) References Cited

U.S. PATENT DOCUMENTS

2018/0221545 A1* 8/2018 Kumta ..... A61L 31/022
2019/0093200 A1* 3/2019 Park ..... C22F 1/06
2020/0087767 A1* 3/2020 Park ..... C22C 23/04

FOREIGN PATENT DOCUMENTS

CN 1596159 A 3/2005
CN 102989764 A 3/2013
(Continued)

OTHER PUBLICATIONS

NPL: on-line translation of KR 20090120194 A1, Nov. 2009 (Year: 2009).*

(Continued)

*Primary Examiner* — Jie Yang
(74) *Attorney, Agent, or Firm* — Morgan, Lewis & Bockius LLP

(57) ABSTRACT

The present invention relates to a magnesium alloy sheet and a manufacturing method thereof. In detail, the magnesium alloy sheet includes 0.5 to 3.5 wt % of Al, 0.5 to 1.5 wt % of Zn, 0.1 to 1.0 wt % of Ca, 0.01 to 1.0 wt % of Mn, a remainder of Mg, and other inevitable impurities with respect to an entire 100 wt % of a magnesium alloy sheet, wherein an average crystal grain size of the magnesium alloy sheet is 3 to 15 μm, the magnesium alloy sheet includes a stringer, and a length of the stringer in a rolling direction (RD) is equal to or less than the maximum value of 50 μm.

5 Claims, 6 Drawing Sheets

| Spectrum | C | O | Mg | Al | Ca | Zn |
|---|---|---|---|---|---|---|
| Spectrum 1 | 9.51 | 4.05 | 71.36 | 10.37 | 4.04 | 0.68 |
| Spectrum 2 | 14.80 | 8.05 | 48.23 | 20.47 | 7.97 | 0.49 |
| Spectrum 3 | 8.76 | 4.18 | 78.73 | 5.44 | 2.11 | 0.77 |

(51) Int. Cl.
*C21D 8/02* (2006.01)
*C22F 1/06* (2006.01)

(58) Field of Classification Search
USPC ..... 420/407
See application file for complete search history.

(56) References Cited

FOREIGN PATENT DOCUMENTS

| | | | |
|---|---|---|---|
| CN | 103909382 | A | 7/2014 |
| CN | 105385912 | A | 3/2016 |
| CN | 110114486 | A | 8/2019 |
| EP | 3572542 | A1 | 11/2019 |
| JP | 2006-016656 | A | 1/2006 |
| JP | 2008-081773 | A | 4/2008 |
| JP | 2008-163398 | A | 7/2008 |
| JP | 4306547 | B2 | 8/2009 |
| JP | 5046178 | B2 | 10/2012 |
| JP | 2016-079451 | A | 5/2016 |
| JP | 2018-141234 | A | 9/2018 |
| KR | 10-2009-0120194 | A | 11/2009 |
| KR | 10-2012-0055304 | A | 5/2012 |
| KR | 10-2015-0065418 | A | 6/2015 |
| KR | 10-1607258 | B1 | 3/2016 |
| KR | 10-1626820 | B1 | 6/2016 |
| KR | 10-1751521 | B1 | 6/2017 |
| KR | 10-2017-0075407 | A | 7/2017 |
| WO | 2017/111550 | A8 | 6/2017 |
| WO | 2018/117695 | A1 | 6/2018 |

OTHER PUBLICATIONS

NPL: on-line translation of JP 2006016656 A, Jan. 2006 (Year: 2006).*
Japanese Office Action dated Jun. 22, 2021 issued Japanese Patent Application No. 2020-535012.
Chinese Office Action dated Mar. 29, 2021 issued in Chinese Patent Application No. 20188083869.3.
Extended European Search Report dated Jan. 28, 2021 issued in European Patent Application No. 18897055.2.
International Search Report dated Apr. 3, 2019 issued in International Patent Application No. PCT/KR2018/016511 (with English translation).

* cited by examiner

| Spectrum | C | O | Mg | Al | Ca | Zn |
|---|---|---|---|---|---|---|
| Spectrum 1 | 9.51 | 4.05 | 71.36 | 10.37 | 4.04 | 0.68 |
| Spectrum 2 | 14.80 | 8.05 | 48.23 | 20.47 | 7.97 | 0.49 |
| Spectrum 3 | 8.76 | 4.18 | 78.73 | 5.44 | 2.11 | 0.77 |

| Spectrum | C | O | Mg | Al | Ca | Mn | Zn |
|---|---|---|---|---|---|---|---|
| Spectrum 1 | 8.84 | 5.45 | 56.01 | 19.59 | 10.11 | | |
| Spectrum 2 | 9.16 | 4.91 | 72.77 | 8.54 | 4.62 | | |
| Spectrum 3 | 10.38 | 5.25 | 66.39 | 12.18 | 5.80 | | |
| Spectrum 4 | 11.28 | 6.44 | 66.54 | 9.17 | 5.95 | | 0.62 |
| Spectrum 5 | 9.45 | 9.29 | 54.17 | 17.81 | 8.72 | | 0.56 |
| Spectrum 6 | 9.70 | 6.76 | 62.60 | 14.79 | 5.83 | 0.33 | |
| Spectrum 7 | | 4.21 | 83.42 | 8.97 | 3.40 | | |

MAGNESIUM ALLOY SHEET AND METHOD FOR PRODUCING SAME

CROSS-REFERENCE OF RELATED APPLICATIONS

This application is the U.S. National Phase under 35 U.S.C. § 371 of International Patent Application No. PCT/KR2018/016511, filed on Dec. 21, 2018, which in turn claims the benefit of Korean Application No. 10-2017-0180115, filed on Dec. 26, 2017, the entire disclosures of which applications are incorporated by reference herein.

BACKGROUND OF THE INVENTION

(a) Field of the Invention

An embodiment of the present invention relates to a magnesium alloy sheet and a manufacturing method thereof.

(b) Description of the Related Art

Recently, interests in materials of which weight may be reduced as structural materials haven increased and active researches thereon are in progress. A magnesium alloy sheet has merits such as the lowest specific gravity, excellent specific strength, and an electromagnetic shielding function from among structural materials, so it is widely used as materials for IT mobile products or vehicles.

However, there are many barriers when the magnesium sheet is used in the vehicle industry. A representative thereof is moldability of the magnesium sheet. The magnesium sheet has an HCP structure, and its deformation mechanism at room temperature is limited, so it is impossible to be formed at room temperature. Many researches have been performed so as to overcome them.

Particularly, there is a method for improving moldability through a process. For example, there are differentiated speed rolling for providing different speeds to an upper roller and a lower roller, an ECAP process, and a high temperature rolling method for performing rolling at around a eutectic temperature of the magnesium sheet. However, the above-noted processes are difficult to be commercially available.

There also is a method for improving moldability through an alloy.

For example, there is a patent on the magnesium sheet containing 1 to 10 wt % of Zn and 0.1 to 5 wt % of Ca. However, the above-noted patent may not be applied to a process for performing casting according to a strip casting method. Therefore, mass production is unacceptable, and it is difficult to perform long-tern casting because of a fusion phenomenon between a casting material and a roll.

Further, there is another patent on a high-forming magnesium alloy sheet with a limited dome height that is equal to or greater than 7 mm by improving the process of an alloy with 3 wt % of Al, 1 wt % of Zn, and 1 wt % of Ca. The above-noted high-forming sheet has an excellent limited dome height, but easily generates cracks when deformed in a transverse direction (TD) in a bending test.

The above information disclosed in this Background section is only for enhancement of understanding of the background of the invention, and therefore it may contain information that does not form the prior art that is already known in this country to a person of ordinary skill in the art.

SUMMARY OF THE INVENTION

The present invention has been made in an effort to provide a magnesium alloy sheet with excellent moldability at room temperature and less anisotropy by controlling a cumulative reduction ratio in a step for manufacturing a magnesium alloy sheet.

An exemplary embodiment of the present invention provides a magnesium alloy sheet including: 0.5 to 3.5 wt % of Al, 0.5 to 1.5 wt % of Zn, 0.1 to 1.0 wt % of Ca, 0.01 to 1.0 wt % of Mn, a remainder of Mg, and other inevitable impurities with respect to an entire 100 wt % of the magnesium alloy sheet.

An average crystal grain size of the magnesium alloy sheet may be 3 to 15 μm.

The magnesium alloy sheet may include a stringer, and a length of the stringer in a rolling direction (RD) may be equal to or less than a maximum value of 50 μm.

A thickness of the stringer in a transverse direction (TD) may be equal to or less than a maximum value of 1 μm on the magnesium alloy sheet.

The magnesium alloy sheet has a limited bending radius (LBR) value in the rolling direction (RD) at equal to or greater than 150° C. that may be equal to or less than 0.5 R/t.

The magnesium alloy sheet has a limited bending radius (LBR) value in the transverse direction (TD) at equal to or greater than 150° C. that may be equal to or less than 1.5 R/t.

An absolute value of a difference between limited bending radius (LBR) values in the rolling direction (RD) and the transverse direction (TD) at equal to or greater than 150° C. may be 0.4 to 1.4.

A thickness of the magnesium alloy sheet may be 0.8 to 1.7 mm.

Another embodiment of the present invention provides a method for manufacturing a magnesium alloy sheet, including: preparing a casting material by casting an alloy melt solution including 0.5 to 3.5 wt % of Al, 0.5 to 1.5 wt % of Zn, 0.1 to 1.0 wt % of Ca, 0.01 to 1.0 wt % of Mn, a remainder of Mg, and other inevitable impurities for the entire 100 wt %; homogenizing and heat-treating the casting material; preparing a rolled material by rolling the homogenized and heat-treated casting material; and finally annealing the rolled material.

In the preparing of a rolled material, a cumulative reduction ratio may be equal to or greater than 86%.

The homogenizing and heat-treating of a casting material may be performed at a temperature of 300 to 500° C. In detail, it may be performed for 4 to 30 hours.

The homogenizing and heat-treating of a casting material may include a first homogenization and heat treatment; and a secondary homogenization and heat treatment.

The first homogenization and heat treatment may be performed at a temperature of 300 to 400° C. In detail, it may be performed for 1 to 15 hours.

The secondary homogenization and heat treatment may be performed at a temperature of 400 to 500° C. In detail, it may be performed for 1 to 15 hours.

The preparing of a rolled material may be performed at a temperature of 200 to 400° C. The preparing of a rolled material may include performing a rolling with a reduction ratio that is greater than 0 and equal to or less than 50% for each rolling.

The preparing of a rolled material may further include intermediately annealing the rolled material.

The intermediately annealing of the rolled material may be performed at a temperature of 300 to 500° C.

In detail, it may be performed for 30 minutes to 10 hours.

The finally annealing of a rolled material may be performed at a temperature of 300 to 500° C. In detail, it may be performed for 10 minutes to 10 hours.

According to the exemplary embodiment of the present invention, the segregation of the secondary phase is dispersed and the secondary phase stringer is reduced by controlling the cumulative reduction ratio in the step of manufacturing a magnesium alloy sheet. Therefore, the difference of physical properties may be reduced when deformed in the rolling direction (RD) and the transverse direction (TD). The moldability at the room temperature may be excellent.

Hence, the magnesium alloy sheet according to an exemplary embodiment of the present invention is applicable to the vehicle field aiming at high strength and light weight. In detail, when vehicle parts are molded, the molding may be possible without generation of cracks in a stretching and bending mode.

DETAILED DESCRIPTION OF THE EMBODIMENTS

Figure 1:
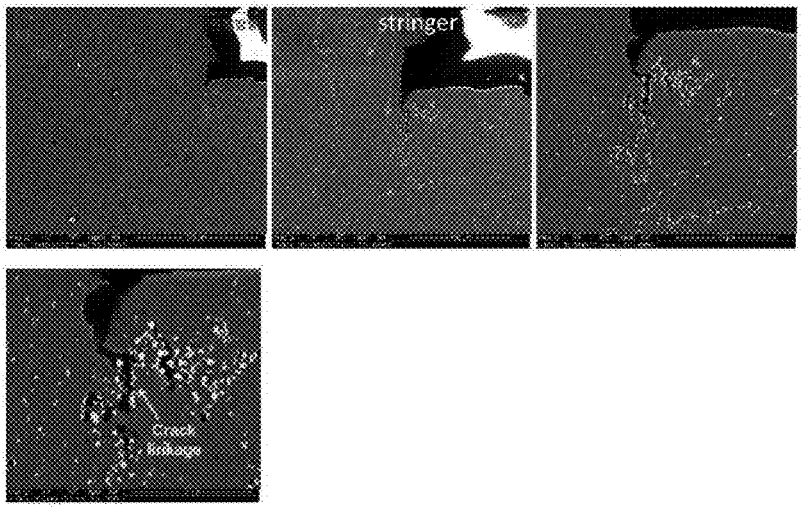
FIG. 1 sequentially shows a crack forming mechanism according to a secondary phase stringer during a tension test in a transverse direction (TD).

The advantages and features of the present invention and the manner of achieving them will become apparent with reference to the embodiments described in detail below with reference to the accompanying drawings. The present invention may, however, be embodied in many different forms, and should not be construed as limited to the embodiments set forth herein. Rather, these embodiments are provided so that this disclosure will be thorough and complete, and will fully convey the scope of the invention to those skilled in the art, and the present invention is defined by the scope of the claims. Like reference numerals designate like elements throughout the specification.

Thus, in some embodiments, well-known techniques are not specifically described to avoid an undesirable interpretation of the present invention. Unless defined otherwise, all terms (including technical and scientific terms) used herein may be used in a sense commonly understood by one of ordinary skill in the art to which this invention belongs. Unless explicitly described to the contrary, the word "comprise" and variations such as "comprises" or "comprising" will be understood to imply the inclusion of stated elements but not the exclusion of any other elements. Also, singular forms include plural forms unless the context clearly dictates otherwise.

The magnesium alloy sheet according to an embodiment of the present invention may include 0.5 to 3.5 wt % of Al, 0.5 to 1.5 wt % of Zn, 0.1 to 1.0 wt % of Ca, 0.01 to 1.0 wt % of Mn, a remainder of Mg, and other inevitable impurities, for the entire 100 wt %.

A reason for limiting a component and a composition of the magnesium alloy sheet will now be described.

Al may be included at 0.5 to 3.5 wt %. In detail, it may be contained at 0.5 to 1.0 wt %. In further detail, aluminum functions to improve moldability at room temperature, so it may be cast by a strip casting method when it is contained in the above-noted content.

In detail, regarding a method for manufacturing a magnesium alloy sheet to be described below, a texture is changed to a strong basal structure when performing rolling in a rolling step. In this instance, a solute dragging effect is provided as a mechanism for suppressing the change to the basal structure. The solute dragging mechanism may reduce boundary mobility, when heated or deformed, as an element such as Ca having a bigger atom radius than Mg is segregated in a crystal boundary. Accordingly, formation of basal texture by dynamic recrystallization or rolling deformation during a rolling process may be suppressed.

Therefore, when more than 3.5 wt % of aluminum is added, an amount of the secondary phase of $Al_2Ca$ also steeply increases, so the amount of Ca segregated to the boundary may be reduced. Accordingly, a solute dragging effect may be reduced. In addition, as the fraction occupied by the secondary phase is reduced, the stringer fraction may also be reduced. The stringer will be described below in detail.

On the contrary, when less than 0.5 wt % of aluminum is added, casting by the strip casting method may be impossible. The aluminum functions to improve fluidity of a molten metal, so it may prevent a roll sticking phenomenon during casting. Therefore, it is impossible to cast a Mg—Zn-based magnesium alloy to which no aluminum is added by using the strip casting method because of an actual roll sticking phenomenon.

0.5 to 1.5 wt % of Zn may be contained.

In further detail, when zinc is added together with calcium, it activates a base slip through a non-basal softening phenomenon, thereby functioning to improve moldability of the sheet. However, when more than 1.5 wt % of zinc is added, it is combined to magnesium to generate an intermetallic compound, which may exercise an adverse effect upon the moldability.

0.1 to 1.0 wt % of Ca may be contained.

When the calcium is included with zinc, a non-basal softening phenomenon is generated to activate a non-basal slip, thereby functioning to improve moldability of the sheet.

In detail, texture has the characteristic of changing to a strong base texture during rolling in the method for manufacturing a magnesium alloy sheet. The solute dragging effect is provided as a mechanism for suppressing the characteristic. In detail, it may reduce boundary mobility, when heated or deformed, as an element having a bigger atom radius than Mg is segregated in a crystal boundary. In this instance, Ca may be used as an element with the bigger atom radius than Mg. In this case, formation of basal texture by dynamic recrystallization or rolling deformation during a rolling process may be suppressed.

However, when more than 1.0 wt % thereof is added, adhesion with a casting roll during a casting process with strip casting occurs, so the sticking phenomenon may increase. Therefore, the casting property is lowered by reducing fluidity of the molten metal, so productivity may be reduced.

0.01 to 1.0 wt % of Mn may be contained.

The manganese forms an Fe—Mn-based compound to thus function to reduce the content of the component of Fe in the sheet. Therefore, when the manganese is contained, an Fe—Mn compound in a form of dross or sludge may be formed in an alloyed molten metal state before performing a casting process. A sheet with a lesser content of the component of Fe may be produced during a casting process. The manganese may form a secondary phase of $Al_8Mn_5$ with aluminum. Accordingly, it functions to increase the amount of calcium that may be segregated to the crystal boundary by suppressing the used amount of calcium. Hence, when manganese is added, the solute dragging effect may be further improved.

Regarding the magnesium alloy sheet, calcium elements may be segregated to the crystal boundary. In this instance, the calcium elements may be segregated to the crystal boundary not in an intermetallic compound form but in a solute form.

In detail, as the calcium does not form a secondary phase with an element such as aluminum but is segregated in a solute form to the boundary, mobility of the boundary is reduced and the basal texture is suppressed. Accordingly, the magnesium alloy sheet with excellent moldability at room temperature may be provided.

An average crystal grain size of the magnesium alloy sheet may be 3 to 15 μm.

To be described later, the average crystal grain size of the magnesium alloy sheet may be in the range when the cumulative reduction ratio is equal to or greater than 86% in the rolling step of the method for manufacturing a magnesium alloy sheet according to another exemplary embodiment of the present invention.

This may be a lower level than the conventional magnesium alloy with a similar component and composition.

Therefore, when the average crystal grain size of the magnesium alloy sheet is like given above, flexibility and moldability may be increased in warm deformation.

The crystal grain size in the present specification signifies a diameter of the crystal grain in the magnesium alloy sheet.

The magnesium alloy sheet may include a stringer.

In the present specification, the stringer signifies that the secondary phases gather together to form a band in the rolling direction (RD).

In detail, a length of the stringer in the rolling direction (RD) in the magnesium alloy sheet may be 50 μm as a maximum or less. A thickness of the stringer in the transverse direction (TD) in the magnesium alloy sheet may be 1 μm as maximum or less.

Including a stringer with the length and the thickness may signify the magnesium alloy sheet according to an exemplary embodiment of the present invention rarely has a stringer.

Physical anisotropy may be big when the length in the rolling direction (RD) is greater than the maximum value of 50 μm or when the stringer with the thickness in the transverse direction (TD) that is greater than the maximum value of 1 μm exists in the magnesium alloy sheet.

The transverse direction (TD) may be perpendicular to the rolling direction (RD).

In detail, when the sheet is bent or extended in the transverse direction (TD), the secondary phase may be broken along the stringer formed in the rolling direction (RD), and a crack may be easily spread. Accordingly, bendability in the transverse direction (TD) may be inferior to bendability in the rolling direction (RD).

Particularly, when the above-noted secondary phase stringer exists near a surface of the magnesium alloy sheet, the crack may be further easily generated when a bending test is performed in the transverse direction (TD) that is perpendicular to the rolling direction.

The crack forming mechanism according to the stringer of the secondary phase may be confirmed through FIG. 1.

FIG. 1 sequentially shows a crack forming mechanism according to a secondary phase stringer during a tension test in the transverse direction (TD).

As shown in FIG. 1, it is found that, when the sheet is extended in the transverse direction (TD), the crack is generated along the secondary phase stringer (white dot) formed in the rolling direction (RD). That is, the stringer of the secondary phase is parallel to the generated direction of the crack, so the trend for the crack to continue along the secondary phase stringer exists.

Therefore, when extended in the transverse direction (TD), the bendability becomes further inferior, because of the crack caused by the stringer, to the case of being extended in the rolling direction (RD). Therefrom, a difference of physical properties between the case of extending (or bending) in the rolling direction (RD) and the case of extending (or bending) in the transverse direction (TD) may be large.

That is, in the present specification, a reference of the secondary phase stringer giving a negative influence to anisotropy is defined to be a stringer having a length in the rolling direction (RD) that is greater than the maximum of 50 μm or having a thickness in the transverse direction (TD) that is greater than the maximum of 1 μm.

The anisotropy signifies that the physical property in the rolling direction (RD) is different from the physical property in the transverse direction (TD). As will be described in a later portion of the present specification, the anisotropy is measured by performing a bending test in the rolling direction (RD) and the transverse direction (TD) through a V-bending test. A limited bending radius (LBR) value through the bending test is indicated as an index of anisotropy.

When it is described that anisotropy is excellent, it signifies that there is a small difference of the physical properties in the rolling direction (RD) and the transverse direction (TD).

The secondary phase configuring the stringer may be $Al_2Ca$, $Al_8Mn_5$, or a combination thereof.

An area of the secondary phase may be 5 to 15% for the entire area 100% of the magnesium alloy sheet. It is not, however, limited thereto, and the secondary phase may not configure a stringer but may be dispersed in the magnesium alloy sheet according to an exemplary embodiment of the present invention.

As described above, the magnesium alloy sheet may have the limited bending radius (LBR) value of equal to or less than 0.5 R/t in the rolling direction (RD) at equal to or greater than 150° C.

The limited bending radius (LBR) value in the transverse direction (TD) at equal to or greater than 150° C. may be equal to or less than 1.5 R/t.

The limited bending radius (LBR) signifies the ratio of a thickness (t) of the sheet vs. an internal curvature radius (R) of the sheet after the V-bending test. In detail, it may be the internal curvature radius (R) of the sheet/the thickness (t) of the sheet. This may be shown as an index of moldability and an index on anisotropy of the physical property.

Regarding the magnesium alloy sheet, an absolute value of a difference between the limited bending radius (LBR) value in the rolling direction (RD) and the limited bending radius (LBR) value in the transverse direction (TD) at equal to or greater than 150° C. may be 0.4 to 1.4.

The range signifies that the difference of the physical properties between the rolling direction (RD) and the transverse direction (TD) is not large. That is, anisotropy of the physical property of the magnesium alloy sheet according to an exemplary embodiment of the present invention is excellent.

The thickness of the above-produced magnesium alloy sheet may be 0.8 to 1.7 mm. When the thickness of the magnesium alloy sheet is like this range, it is usable in the vehicle field aiming at high strength and light weight.

A method for manufacturing a magnesium alloy sheet according to another exemplary embodiment of the present invention may include: preparing a casting material by casting an alloy melt solution including 0.5 to 3.5 wt % of Al, 0.5 to 1.5 wt % of Zn, 0.1 to 1.0 wt % of Ca, 0.01 to 1.0 wt % of Mn, a remainder of Mg, and other inevitable impurities for the entire 100 wt %; homogenizing and heat-treating the casting material; preparing a rolled material by rolling the homogenized and heat-treated casting material; and finally annealing the rolled material.

First, regarding the preparing of a casting material by casting an alloy melt solution, the casting may be performed by die-casting, direct chill casting, billet casting, centrifugal casting, tilt casting, die gravity casting, sand casting, strip casting, or a combination thereof. However, the method is not limited thereto.

The thickness of the casting material may be equal to or greater than 7.0 mm.

The reason for limiting the component and composition of the alloy melt solution corresponds to the above-described reason for limiting the component and the composition of the magnesium alloy sheet, so it will not be described.

The homogenizing and heat-treating of the casting material may be performed at a temperature of 300 to 500° C.

In detail, it may be performed for 4 hours to 30 hours.

In further detail, the homogenizing and heat-treating of the casting material may be divided into a first homogenizing and heat-treating step, and a secondary homogenizing and heat-treating step.

The first homogenizing and heat-treating step may be performed at a temperature of 300 to 400° C. In detail, it may be performed for 1 hour to 15 hours.

The secondary homogenizing and heat-treating step may be performed at a temperature of 400 to 500° C. In detail, it may be performed for 1 hour to 15 hours.

In further detail, a stress generated in the casting step may be settled when the homogenizing and heat treatment is performed at the temperature and for the range of hours. When the step is divided into the first and secondary homogenizing and heat treatment steps and they are then performed, the secondary phase generating a melting phenomenon at equal to or greater than 350° C. may be removed in the first homogenizing and heat-treating step. Accordingly, the stress settling time may be reduced.

In detail, in the first heat-treating step, a ternary intermetallic compound of Mg—Al—Zn may be solution-treated. When the secondary heat-treating step is performed without performing the first heat treating step, the intermetallic compound may cause incipient melting to generate pores in the material.

In the secondary heat-treating step, beta phases such as $Mg_{17}Al_{12}$ may be solution-treated, and a dendrite form produced during casting may be changed to a recrystallized grain.

In the step of preparing a rolled material by rolling the homogenized and heat-treated casting material, the cumulative reduction ratio may be equal to or greater than 86%.

The reduction ratio represents an operation of dividing a difference between a thickness of a material before passing through a rolling roll during rolling and a thickness of the material after passing through the rolling roll by the thickness of the material before passing through the rolling roll, and then multiplying a resultant value by 100.

In detail, the cumulative reduction ratio represents an operation of dividing the difference between the thickness of the casting material and the thickness of the final rolled material by the thickness of the casting material and multiplying a resultant value by 100. Therefore, the cumulative reduction ratio may also signify total reduction ratios performed until the final rolled material is produced from the casting material.

Therefore, when the cumulative reduction ratio is equal to or greater than 86%, a crystal grain size of the produced magnesium alloy sheet according to an exemplary embodiment of the present invention may be fine. In detail, the average crystal grain size of the magnesium alloy sheet may be 3 to 15 μm.

Further, when the cumulative reduction ratio is within the range, the secondary phase gathered together in a segregation zone is dispersed to reduce a generation probability of stringers. By this, the factor of causing cracks may be reduced when a deformation is generated in the transverse direction (TD) that is perpendicular to the rolling direction (RD).

The preparing of the rolled material may be performed at a temperature of 200 to 400° C.

In detail, when the rolling temperature is like the above-noted range, the rolling may be performed without generation of cracks. When the rolling is performed at the temperature, segregation of Ca to the grain boundary may be easy.

In detail, the rolling may be performed with a reduction ratio that is greater than 0 and equal to or less than 50% for each rolling. A plurality of rollings may also be performed. Accordingly, the cumulative reduction ratio may be equal to or greater than 86% as described above.

The preparing of the rolled material may further include intermediately annealing the rolled material.

The intermediately annealing of the rolled material may be performed at a temperature of 300 to 500° C. It may be performed for 30 minutes to 10 hours.

In detail, when intermediate annealing is performed in the above-noted condition, the stress generated during rolling may be sufficiently settled. In further detail, the stress may be settled through recrystallization in the range that is not greater than the fusion temperature of the rolled material.

Finally, the finally annealing of the rolled material may be performed at a temperature of 300 to 500° C. In detail, it may be performed for 10 minutes to 10 hours.

The recrystallization may be easily formed by performing final annealing in the condition.

This will be described in detail through an example. The example below exemplifies the present invention, and a content of the present invention is not limited by the example.

PREPARATION EXAMPLE

An alloy melt solution including 3.0 wt % of Al, 0.8 wt % of Zn, 0.6 wt % of Ca, 0.3 wt % of Mn, a remainder of Mg, and other inevitable impurities with respect to the entire 100 wt % is prepared.

A casting material is prepared by casting the melt solution by a strip casting method.

The casting material is first homogenized and heat-treated for 1 hour at 350° C.

The same is secondarily homogenized and heat treated for 24 hours at 400 to 500° C.

The homogenized and heat-treated casting material is rolled with a reduction ratio of 15 to 25% for each rolling at 200 to 400° C. However, the rolling is performed so that the cumulative reduction ratios (total reduction ratio) according to an example and a comparative example may be different. This is controlled by a number of rollings.

Intermediate annealing is performed in the middle of the rolling. In detail, it is performed for 1 hour at 300 to 500° C.

Finally, the rolled material is annealed at 300 to 500° C.

The thickness of the above-produced magnesium alloy sheet is 1 mm.

[Limited Bending Radius (V-Bending) Measuring Method]

A result according to a V-bending test is referred to as a limited bending radius (LBR). In detail, it represents an internal curvature radius(R) of the sheet after a test/a value of the thickness (t) of the sheet.

In detail, the temperature is controlled until it reaches a target temperature by installing a hot wire so as to heat the device including a die and a punch. The die and the punch may respectively have an angle of 90°. Regarding the types of the punch, curvature radii are 0 R to 9 R.

After the sheet is bent by using the device, R of the punch that is bent without cracks is determined. In this instance, the bending speed of the punch is measured to be 30 to 60 mm per second.

A mechanical 60 ton servo press is used for the device, and a V-bending mold including a punch and a die is installed in the press and is then used.

TABLE 1

| Classify | Cumulative reduction ratio (%) | Casting thickness (mm) | Direction | Room temperature LDH (mm) | Room temperature YS (MPa) | Room temperature El. (%) | Room temperature(RT) LBR (Limited bending radius) (R/t) | 150° C. | 200° C. | 250° C. |
|---|---|---|---|---|---|---|---|---|---|---|
| Comparative | 76.7 | 4.3 | RD | 6.5 | 143 | 23.5 | 1.8 | 1.5 | 0.9 | 0.4 |
| Example 1 | | | TD | | 132 | 15.2 | 4.1 | 3.1 | 2.7 | 2.7 |
| Comparative | 85.7 | 7.0 | RD | 6.8 | 151 | 26.5 | 3.6 | 1.5 | 0.4-0.9 | 0.4 |
| Example 2 | | | TD | | 142 | 18.3 | 4.0-4.5 | 2.5 | 1.8 | 1.2 |
| Example 1 | 89.2 | 9.3 | RD | 7.2 | 136 | 25.0 | 2.1 | 0 | 0 | 0 |
| | | | TD | | 123 | 23.1 | 2.5 | 1.25 | 0-0.4 | 0-0.4 |

Estimation on the above-produced tensile strength (YS), elongation (El), limited dome height (LDH), and limited bending radius (LBR) according to an exemplary embodiment and a comparative example is shown in Table 1.

In this instance, a method for estimating physical properties is as follows.

[Tensile Strength Measuring Method]

The tensile strength signifies a value found by dividing a maximum tensile load until a test piece is broken by a cross-section of a test piece before a test is performed. In detail, it is measured by using a uniaxial tensile tester at room temperature, and a strain rate is given as $10^{-3}$/s.

[Elongation Measuring Method]

The elongation represents a ratio for a material to increase during a tensile test, and it signifies a value shown by a percentage of a changed length of a test piece against a length of the test piece before a test is performed. In detail, it is equivalent to a tensile strength measuring condition, and an increased length against an initial length of a gauge part.

[Erichsen Index Measuring Method]

A magnesium alloy sheet with a horizontal length and a vertical length of respectively 50 to 60 mm is used, and a lubricant is used on an exterior side of the sheet so as to reduce friction between the sheet and a spherical punch.

In this instance, when the test is performed, the die and the spherical punch are at room temperature.

In detail, the magnesium alloy sheet is inserted between an upper die and a lower die, an exterior circumference portion of the sheet is fixed with a force of 10 kN, and the sheet is deformed at a speed of 5 mm/min by using a spherical punch with a diameter of 20 mm. The punch is inserted until the sheet is broken, and when it is broken, a deformed height of the sheet is measured.

The above-noted deformed height of the sheet is referred to as an Erichsen value or a limited dome height (LDH).

Physical properties of the magnesium alloy sheet according to the cumulative reduction ratios according to an example and comparative examples are expressed in Table 1.

As expressed in Table 1, it is found that as the cumulative reduction ratio increases, the differences of the physical properties on the rolling direction (RD) and the transverse direction (TD) are reduced. It is also found that as the cumulative reduction ratio increases, the limited dome height (LDH) value increases. In detail, the limited dome height (LDH) value of Example 1 with the highest cumulative reduction ratio of 89.2% is 7.2 mm which is an excellent value.

It is also found in Example 1 that the limited bending radius (LBR) value in the rolling direction (RD) at equal to or greater than 150° C. is 0, and the limited bending radius (LBR) value in the transverse direction (TD) is 1.25.

When the limited bending radius (LBR) value is low, it signifies that it is tolerable in a severe bending condition.

Accordingly, it is found that the magnesium alloy sheet according to an exemplary embodiment of the present invention has excellent moldability and anisotropy.

The above-noted result may be found from the drawings.

Figure 2:
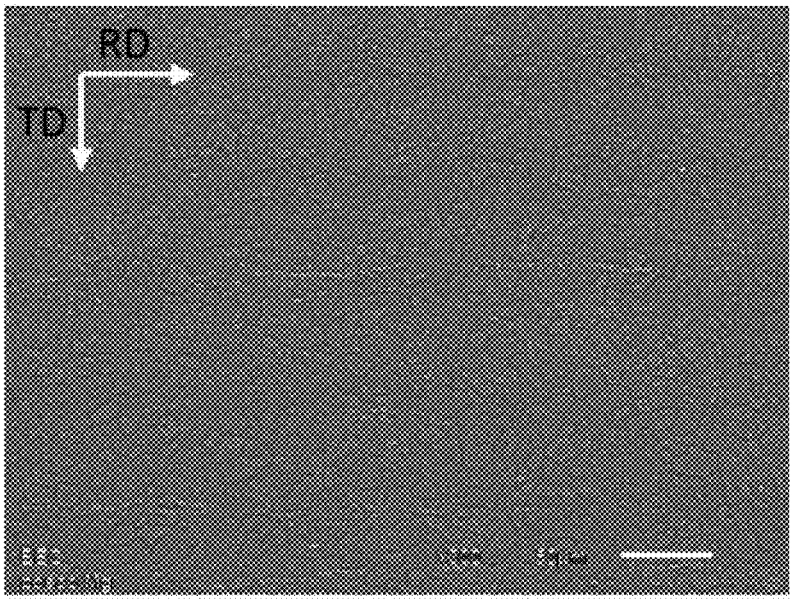
FIG. 2 shows an observation of a microstructure of Example 1 with a SEM.

FIG. 2 shows an observation of a microstructure of Example 1 with a SEM.

In Table 1, Example 1 has a cumulative reduction ratio of 89.2%. As a result, as shown in FIG. 2, the user may find that the secondary phase stringer of which a length in the rolling direction (RD) is greater than the maximum of 50 μm or a thickness in the transverse direction (TD) is greater than the maximum of 1 μm is obtained.

In detail, it is found that some of the secondary phases (white dots) are gathered together, and the length in the rolling direction (RD) is equal to or less than 50 μm or the thickness in the transverse direction (TD) is equal to or less than 1 μm.

Figure 3:
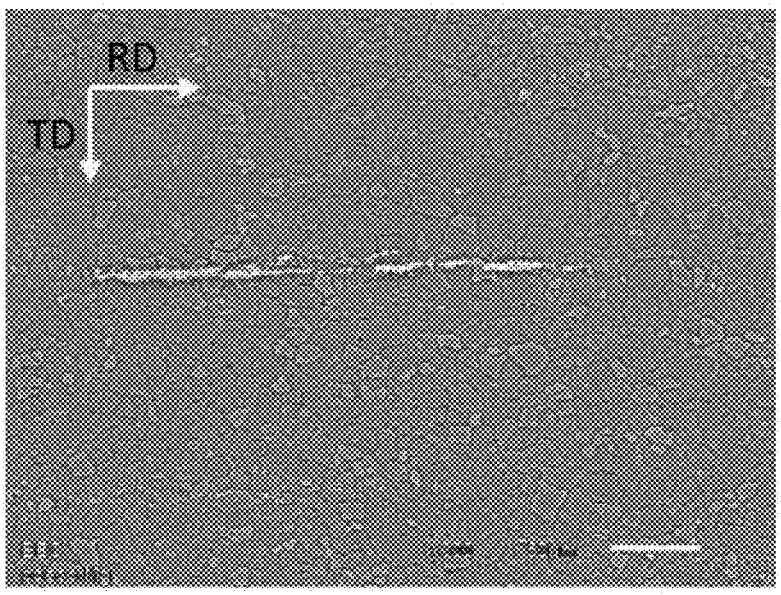
FIG. 3 shows an observation of a microstructure of Comparative Example 1 with a SEM.

FIG. 3 shows an observation of a microstructure of Comparative Example 1 with a SEM.

As shown in FIG. 3, it is found in Comparative Example 1 that the secondary phase stringers like the white dots are gathered together in the rolling direction (RD).

Therefrom, the reason that the difference of the physical properties of the rolling direction (RD) and the transverse direction (TD) of the comparative example 1 is the biggest may be determined.

Figure 4:
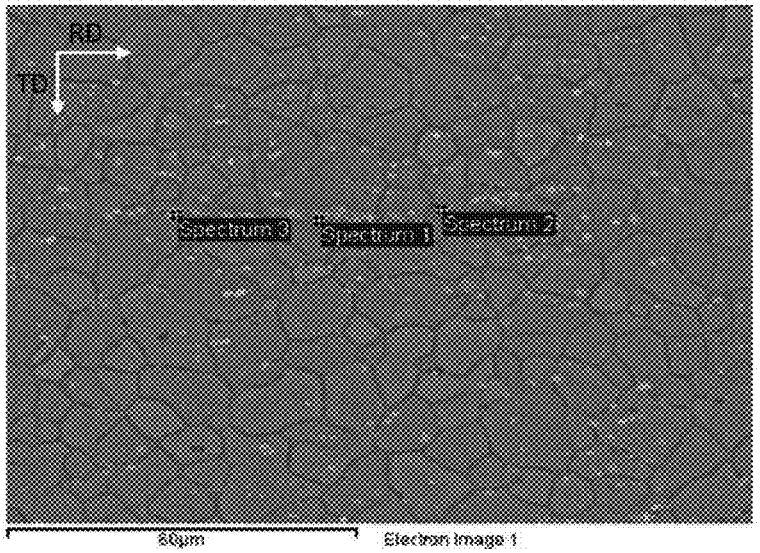
FIG. 4 shows a photograph obtained by enlarging a point including a secondary phase stringer of Example 1 and observing the same with a SEM, and a result of an EDS analysis of a secondary phase.

FIG. 4 shows a photograph obtained by enlarging a point including a secondary phase stringer of Example 1 and observing the same with a SEM, and a result of an EDS analysis of a secondary phase.

Figure 5:
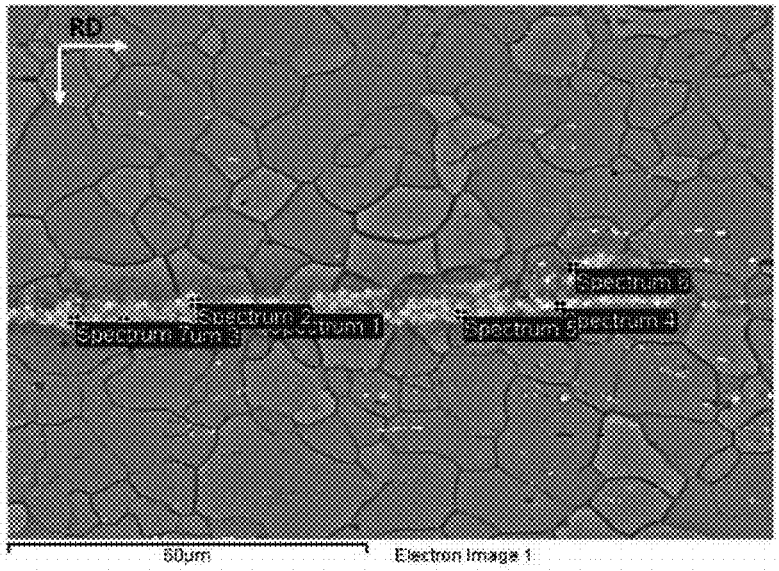
FIG. 5 shows a photograph obtained by enlarging a point including a secondary phase stringer of Comparative Example 1 and observing the same with a SEM, and a result of an EDS analysis of a secondary phase.

FIG. 5 shows a photograph obtained by enlarging a point including a secondary phase stringer of Comparative Example 1 and observing the same with a SEM, and a result of an EDS analysis of a secondary phase.

As shown in FIG. 5, when the components of the secondary phase stringer of the comparative example 1 are analyzed with the EDS, it is found that $Al_2Ca$ or $Al_8Mn_5$ are present in the largest quantity.

In detail, when deformed in the transverse direction (TD), cracks may be generated along the stringer generated as the secondary phases gather together and are formed in the rolling direction (RD). Therefore, the reason that the difference of the physical properties of the rolling direction (RD) and the transverse direction (TD) of Comparative Example 1 is the biggest may be determined.

Figure 6:
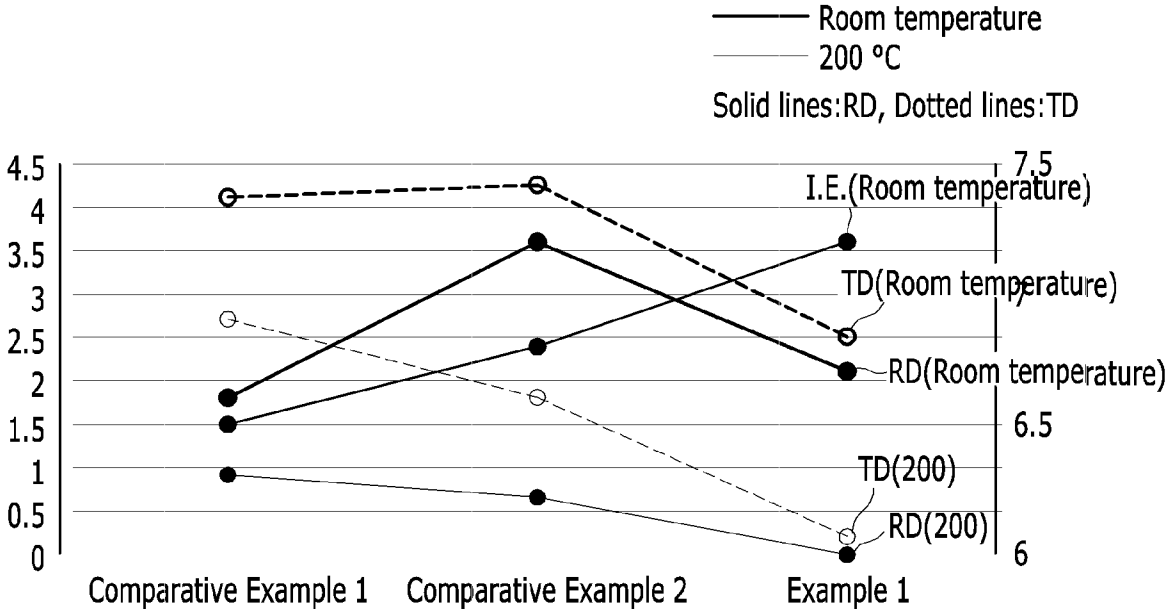
FIG. 6 shows a graph on bendability with respect to cumulative reduction ratios of Comparative Example 1, Comparative Example 2, and Example 1.

FIG. 6 shows a graph of bendability with respect to cumulative reduction ratios of Comparative Example 1, Comparative Example 2, and Example 1.

As shown in FIG. 6, it is found that Example 1 has the smallest difference of the physical properties of the rolling direction (RD) and the transverse direction (TD) at room temperature and at 200° C.

In detail, it is found that, as the cumulative reduction ratio increases, the difference of the physical properties of the rolling direction (RD) and the transverse direction (TD) is reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The range of the present invention is provided in the claims to be described rather than the above-described detailed description, and all modifications or modified forms drawn from the meanings, range, and equivalent concepts of the claims of the patent have to be interpreted to be included in the range of the present invention.

What is claimed is:

1. A magnesium alloy sheet comprising:

0.5 to 3.5 wt % of Al, 0.5 to 1.5 wt % of Zn, 0.1 to 1.0 wt % of Ca, 0.01 to 1.0 wt % of Mn, a remainder of Mg, and other inevitable impurities with respect to an entire 100 wt % of the magnesium alloy sheet, wherein an average crystal grain size of the magnesium alloy sheet is 3 to 15 μm, wherein the magnesium alloy sheet has a limited bending radius (LBR) value in a rolling direction (RD) at equal to or greater than 150° C. that is equal to or less than 0.5, wherein an absolute value of a difference between the limited bending radius (LBR) value in the rolling direction (RD) and transverse direction (TD) at equal to or greater than 150° C. is 0.4 to 1.4.

2. The magnesium alloy sheet of claim 1, wherein the magnesium alloy sheet includes a stringer, and a length of the stringer in the rolling direction (RD) is equal to or less than a maximum value of 50 μm.

3. The magnesium alloy sheet of claim 2, wherein a thickness of the stringer in the transverse direction (TD) is equal to or less than a maximum value of 1 μm on the magnesium alloy sheet.

4. The magnesium alloy sheet of claim 1, wherein the magnesium alloy sheet has the limited bending radius (LBR) value in the transverse direction (TD) at equal to or greater than 150° C. that is equal to or less than 1.5.

5. The magnesium alloy sheet of claim 1, wherein a thickness of the magnesium alloy sheet is 0.8 to 1.7 mm.

* * * * *